US007337509B2

(12) United States Patent
Kondo et al.

(10) Patent No.: US 7,337,509 B2
(45) Date of Patent: Mar. 4, 2008

(54) SLIDE FASTENER

(75) Inventors: Yuji Kondo, Toyama-ken (JP); Yasuaki Funo, Toyama-ken (JP); Miyako Tamura, Toyama-ken (JP); Eriko Sakamoto, Toyama-ken (JP); Iku Sato, Toyama-ken (JP); Takumi Itagawa, Toyama-ken (JP)

(73) Assignee: YKK Corporation, Tokyo (JP)

( * ) Notice: Subject to any disclaimer, the term of this patent is extended or adjusted under 35 U.S.C. 154(b) by 56 days.

(21) Appl. No.: 11/294,277

(22) Filed: Dec. 5, 2005

(65) Prior Publication Data

US 2006/0130292 A1 Jun. 22, 2006

(30) Foreign Application Priority Data

Dec. 16, 2004 (JP) ..... 2004-364524

(51) Int. Cl.
*A44B 19/06* (2006.01)

(52) U.S. Cl. ..... 24/405; 24/408

(58) Field of Classification Search ..... 24/403–414
See application file for complete search history.

(56) References Cited

U.S. PATENT DOCUMENTS 1,850,160 A * 3/1932 Sundback ..... 24/409
4,067,089 A * 1/1978 Forno ..... 24/411
4,349,943 A * 9/1982 Moertel ..... 24/410

* cited by examiner

*Primary Examiner*—James R. Brittain
(74) *Attorney, Agent, or Firm*—Alston & Bird LLP

(57) ABSTRACT

The invention provides a fastener slider, wherein the fastener element comprising an element main body constituted of a base portion attached to a fastener tape, a neck portion and an engaging head portion continuous from the neck portion and expanding in a tape length direction and stiffening means provided on the element main body, allowing a fastener stringer to bend when the elements are separated and inhibiting the fastener chain from bending when the elements are engaged in a stiffening condition, the stiffening means having a first firm contact face making firm contact with mating stiffening means when the elements are engaged and a second firm contact face making firm contact with a partial surface of the engaging head portion of the fastener element when the elements are engaged, thereby the slide fastener having a rigid, linear or curved rod-like configuration when fastener elements are engaged, allowing it to deform in multiple directions.

10 Claims, 11 Drawing Sheets

SLIDE FASTENER

BACKGROUND OF THE INVENTION

1. Field of the Invention

The present invention relates to a slide fastener, which stiffens maintaining linear condition or curved condition such that its fastener chain does not bend when fastener elements are in engagement condition although its fastener stringers have plasticity as conventionally when the fastener elements are separated.

2. Description of the Related Art

In a conventionally known ordinary slide fastener, the mounting interval of fastener elements is set relatively wide to such an extent not deteriorating an engagement strength in order to fit an engaging head portion of a mating fastener element between the engaging head portions of adjoining fastener elements. As a result, a slight gap exists between the engaged fastener elements, so that the engaged fastener elements make contact with each other through a point and thus move freely in the range of that gap.

As described above, when the fastener elements are engaged, the configuration of the slide fastener deforms in various ways, for example, in a tape width direction or in a direction perpendicular to the tape face, because there exists a gap between the engaged fastener elements in case of the conventional slide fastener, which does not have a function for maintaining its configuration in a stable condition by stiffening the configuration.

An object of the present invention is to provide a slide fastener having a structure and function not seen conventionally, in which when the fastener elements are engaged, the slide fastener stiffens maintaining its configuration in the length direction, so that it turns to just a rigid, linear or curved rod and when the fastener elements are separated, it has flexibility and plasticity so that it deforms in multiple directions like a rope.

SUMMARY OF THE INVENTION

The above object is achieved by a basic configuration of the present invention, namely, a slide fastener having a pair of right and left fastener stringers in which a large number of fastener elements are attached at a predetermined pitch in a length direction of fastener tapes, being characterized in that each fastener element comprises an element main body having a base portion attached to each fastener tape or a string body and an engaging head portion expanding in the length direction of the fastener tape or the string body; and stiffening means which is provided on the element main body, allowing the fastener stringers to bend when the fastener elements are separated and the stiffening means stiffening and blocking the fastener chain from bending when the fastener elements are engaged.

Preferably, an attachment hole for attaching a mounting object body with an attaching string is formed in the base portion, and the slide fastener is attached on the mounting object body.

The fastener elements stiffen when they engage each other by applying the stiffening means to a fastener element having an ordinary structure, so that it can exert a function as a reinforcement material for stabilizing the configuration of each product by that stiffness. Further, the fastener elements can be deformed with a deformation of various kinds of products when they are separated, so that they never turn to an obstacle when that product is put away, like an ordinary slide fastener. Because the stiffening means is applicable to the conventional fastener element, it can meet various kinds of conventional fastener elements without any influence of their element configuration.

The slide fastener of the present invention having the above-described structure can be expanded to new application fields. For example, by attaching the slide fastener of the present invention to an edge of a sheet material constituting a tent and then only by engaging the slide fasteners attached to the edge of the sheet material, not only the respective sheet materials can be joined together but also the slide fastener can be made to function as a reinforcement core material for the tent because the slide fastener stiffens like a rod. Further, if the sheets are separated by releasing the engagement of the slide fastener when putting the tent away, the slide fastener turns deformable with the sheet material so that it can be folded down with the sheet material.

If this slide fastener is attached to the edges of fabric, which covers a broken portion at a time of fracture, and the fastener elements are engaged, both edges of the fabric can be joined and the slide fastener stiffens like a rod, so that the slide fastener can be made to function as a reinforcement material for supporting and fixing the broken portion. Upon non-use, it can be put away with the fabric, and stored like the above described tent.

Preferably, the stiffening means comprises a first firm contact plane which makes firm contact with mating stiffening means when the fastener elements are engaged.

Consequently, when elements are engaged, it makes firm contact with an adjoining fastener element through a plane, thereby preventing them from rotating in multiple directions securely, maintaining the engagement condition of the fastener elements, so that the entire slide fastener at the time of engagement is stiffened by using stiffness of the fastener element. At this time, if the firm contact area of the first firm contact plane is increased as much as possible, the maintenance performance of the engagement condition is intensified.

Preferably, the stiffening means comprises a second firm contact plane which makes firm contact with a partial surface of the engaging head portion of a mating fastener element when the fastener elements are engaged.

Consequently, the engagement of the fastener elements is stabilized further because the motion of each fastener element is restricted by the first firm contact plane and the second firm contact plane.

Preferably, the stiffening means comprises one or more rectangular swollen portions swollen respectively on first and second surfaces of the element main body; the first firm contact plane is a side face extending in a fastener tape traversing direction and/or in a tape length direction of each rectangular swollen portion while the second firm contact plane is an opposing face of the rectangular swollen portion which makes firm contact with a part of the first and second surfaces of the engaging head portion of the mating fastener element upon engagement.

If the stiffening means is constituted of the engaging head portion of the element main body and the rectangular swollen portions provided on the first and second surfaces of the neck portion, the element side faces, which are the first firm contact planes, make firm contact with each other when the fastener elements are engaged, so that adjoining fastener elements are nipped strongly thereby preventing a rotation in the direction of a tape plane and a rotation in a direction perpendicular to the tape plane effectively. At the same time, second firm contact plane turns to a plane along a different direction from the first firm contact plane and when the fastener elements are engaged, part of each rectangular swollen portion makes firm contact with the engaging head portion of a mating fastener element and part of the first and second surfaces of the neck portion, so that rotations of each fastener element are blocked from a different direction, thereby stabilizing the engagement condition more.

Preferably, a concave portion, to which a part of the engaging head portion of the mating fastener element is fitted, is formed between the rectangular swollen portions swollen on the first and second surfaces.

In this case, by forming a concave portion, to which part of the engaging head portion of the mating fastener element is fitted between the rectangular swollen portions provided protrudedly on the first and second surfaces, the second firm contact plane is obtained. Because front and rear faces of part of the engaging head portion of the mating element main body are sandwiched by the respective second firm contact planes of the rectangular swollen portions provided protrudedly on the first and second surfaces, the rotation of the fastener element is blocked and further, the slide fastener can resist a pushing force in a direction of front face to rear face, so that the stiffening condition of the slide fastener can be maintained stably when the fastener elements are engaged.

Preferably, the rectangular swollen portions are disposed at an equal interval (P) in the length direction of the fastener tapes and a pitch (P) between adjoining rectangular swollen portions is set to be smaller than twice a width dimension (W) in the length direction of the fastener tapes of the respective rectangular swollen portions.

Consequently, when the fastener elements are engaged, a force trying to push away the engaging elements in the length direction of the fastener tape acts between the engaging elements and adhesion between the engaging fastener elements is increased by that force. As a result, the engagement condition is stabilized further so that the degree of stiffening of the slide fastener when the fastener elements are engaged further increases.

Preferably, the respective rectangular swollen portions of the first and second surfaces of the fastener element are a square or a rectangular having a same size.

If the width dimension in the tape length direction of the rectangular swollen portion projecting from the first surface of the fastener element is equal to the width dimension in the tape length direction of the rectangular swollen portion projecting from the second surface, the slide fastener stiffens linearly when the fastener elements are engaged.

Preferably, the rectangular swollen portion of the first surface and the rectangular swollen portion of the second surface have a same shape and a width dimension (W1) of a first end portion in a tape length direction on an attachment side of the fastener element of the respective rectangular swollen portions is set to be longer than a width dimension (W2) of a second end portion in a tape length direction on a side of the engaging head portion of the fastener element.

Consequently, a rigid slide fastener of circular form or circular arc having a predetermined radius such that it is curved along a tape flat surface, is obtained.

Preferably, right and left side faces extending along a tape traversing direction formed by joining the first end portion with the second end portion of the respective rectangular swollen portions of the first and second surfaces are formed to be an inclined face with a same inclination angle ($\alpha$).

Preferably, a width dimension (W3) in a tape length direction of the rectangular swollen portion on the first surface side is set to be longer than a width dimension (W4) in the tape length direction of the rectangular swollen portion on the second surface side by a predetermined ratio.

Preferably, right and left side faces extending in the tape traversing direction of the respective rectangular swollen portions disposed on the first surface and the second surface are formed to be an inclined face having an inclination angle ($\beta$) in a tape penetrating direction.

Further, the slide fastener of the present invention can produce a portion which stiffens linearly and a portion which stiffens in a curved condition when the fastener elements are engaged, by disposing fastener elements of the same shape whose rectangular swollen portion is completely square or rectangular in a predetermined length area while disposing fastener elements having the aforementioned inclination angle ($\alpha$) or inclination angle ($\beta$) in other length area.

In case where the width dimension in the tape length direction of the rectangular swollen portion projecting from the first surface of the fastener element is set larger than the width dimension in the tape length direction of the rectangular swollen portion projecting from the second surface by a predetermined ratio and the width dimension in the length direction of the rectangular swollen portions disposed on the first and second surface sides are different, if the side faces extending in the tape traversing direction of each rectangular swollen portion are formed to be inclined faces having a predetermined circular angle ($\alpha$), a rigid slide fastener of circular form or circular arc having a predetermined radius such that it is curved in a direction of winding a tape flat surface when the fastener elements are engaged, is obtained.

In the meantime, if fastener elements each having the same shape, whose rectangular swollen portion is completely square or rectangular are disposed in a predetermined length area of the slide fastener while other fastener elements having an inclined face having the inclination angle ($\alpha$) or the inclination angle ($\beta$) are disposed in other length area, when the slide fastener mounted on a traveling bag is closed, the linear portion and the curved portion both stiffens, maintaining a stable configuration of the bag and when the slide fastener is opened, the fastener stringers can be folded down together with the bag like an ordinary fastener stringer or that slide fastener can be kept the open portion thereof largely open. The effects which the present invention exerts are considerably great.

DESCRIPTION OF THE PREFERRED EMBODIMENTS

Hereinafter, typical embodiments of the slide fastener of the present invention will be described in detail with reference to the accompanying drawings.

Figure 1:
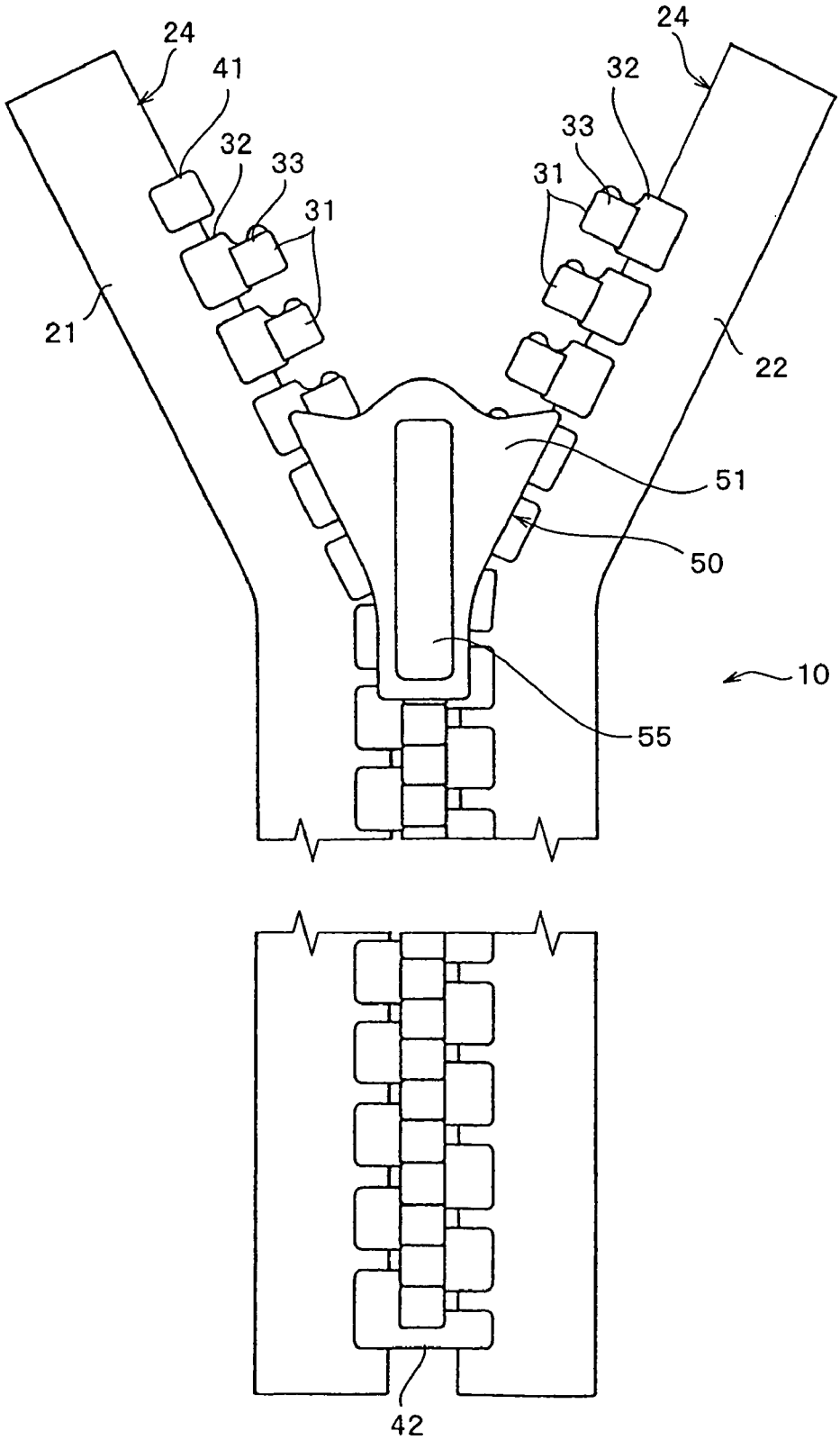
FIG. 1 is a plan view showing an example of a slide fastener of the present invention.
Figure 2:
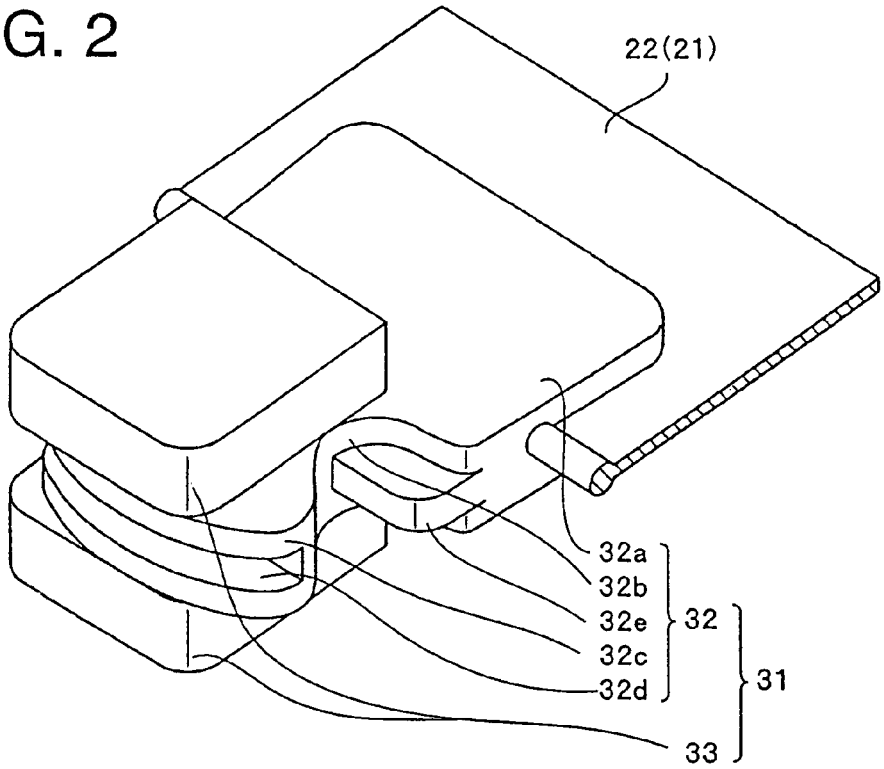
FIG. 2 is a perspective view showing a fastener element of the slide fastener according to a first embodiment of the present invention and its mounting condition.
Figure 3:
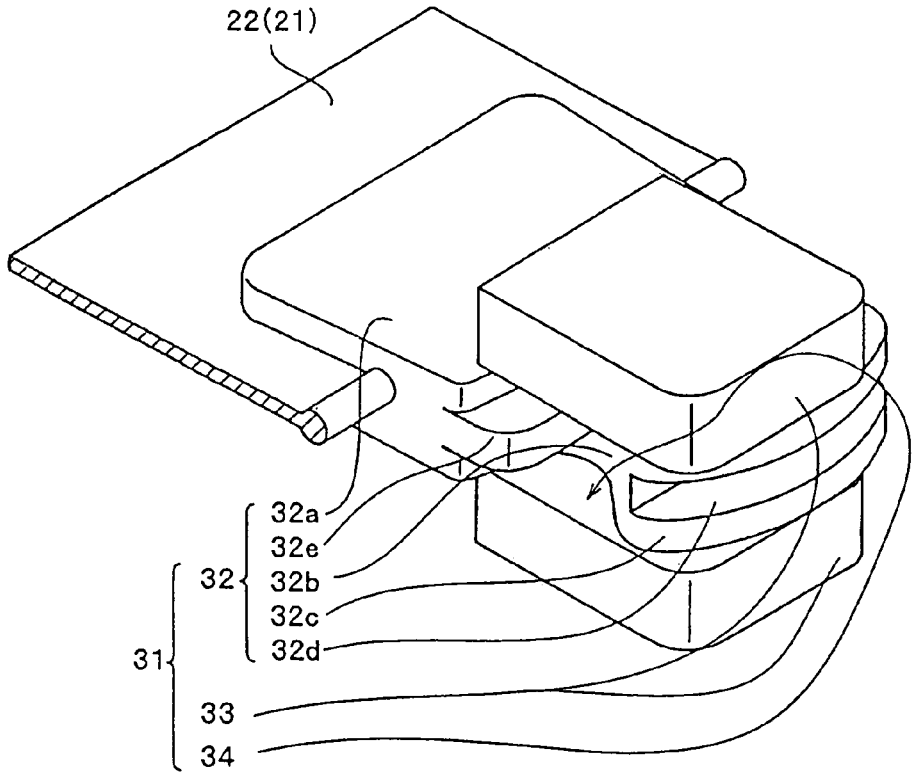
FIG. 3 is a perspective view of the condition of FIG. 2 as seen from an opposite side.
Figure 4:
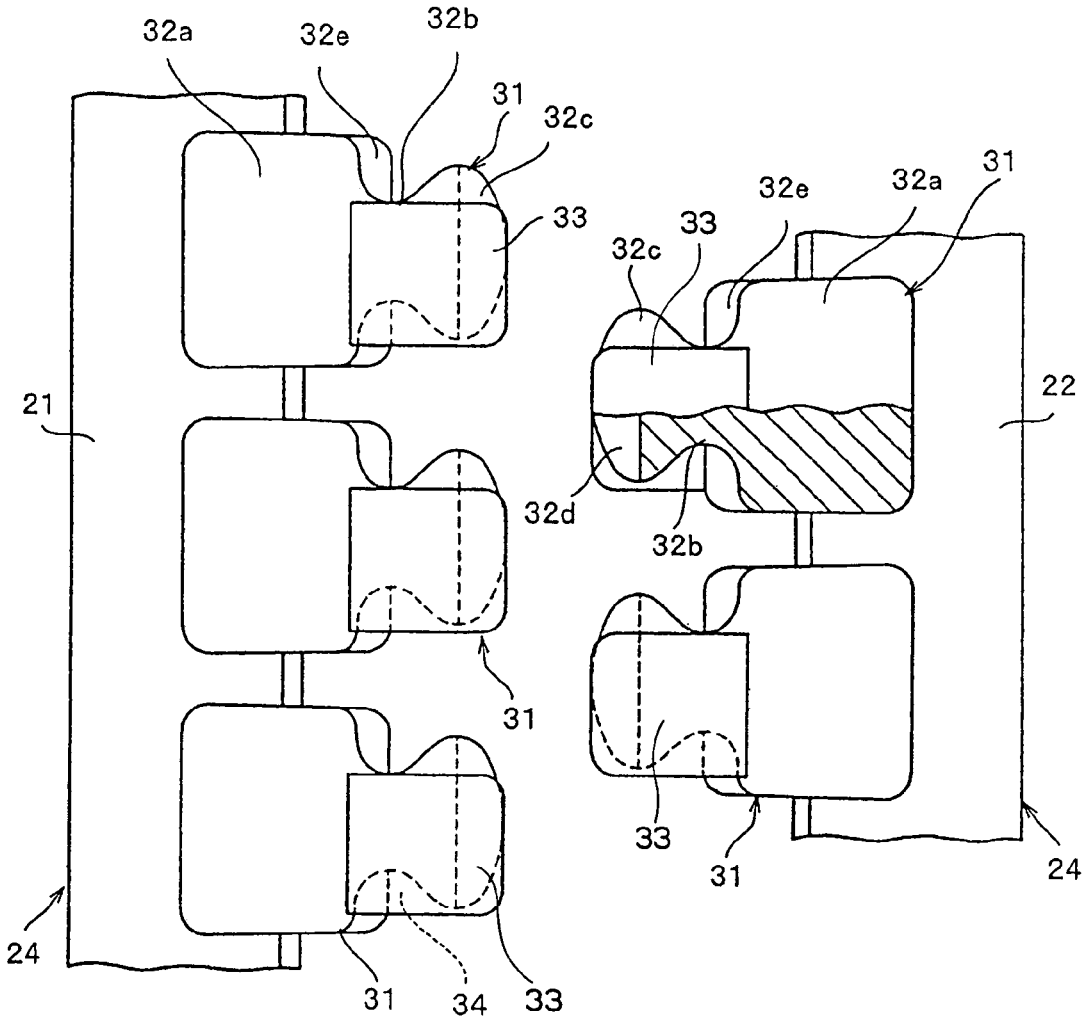
FIG. 4 is a partially dissected plan view of a condition before the elements of the slide fastener engage.
Figure 5:
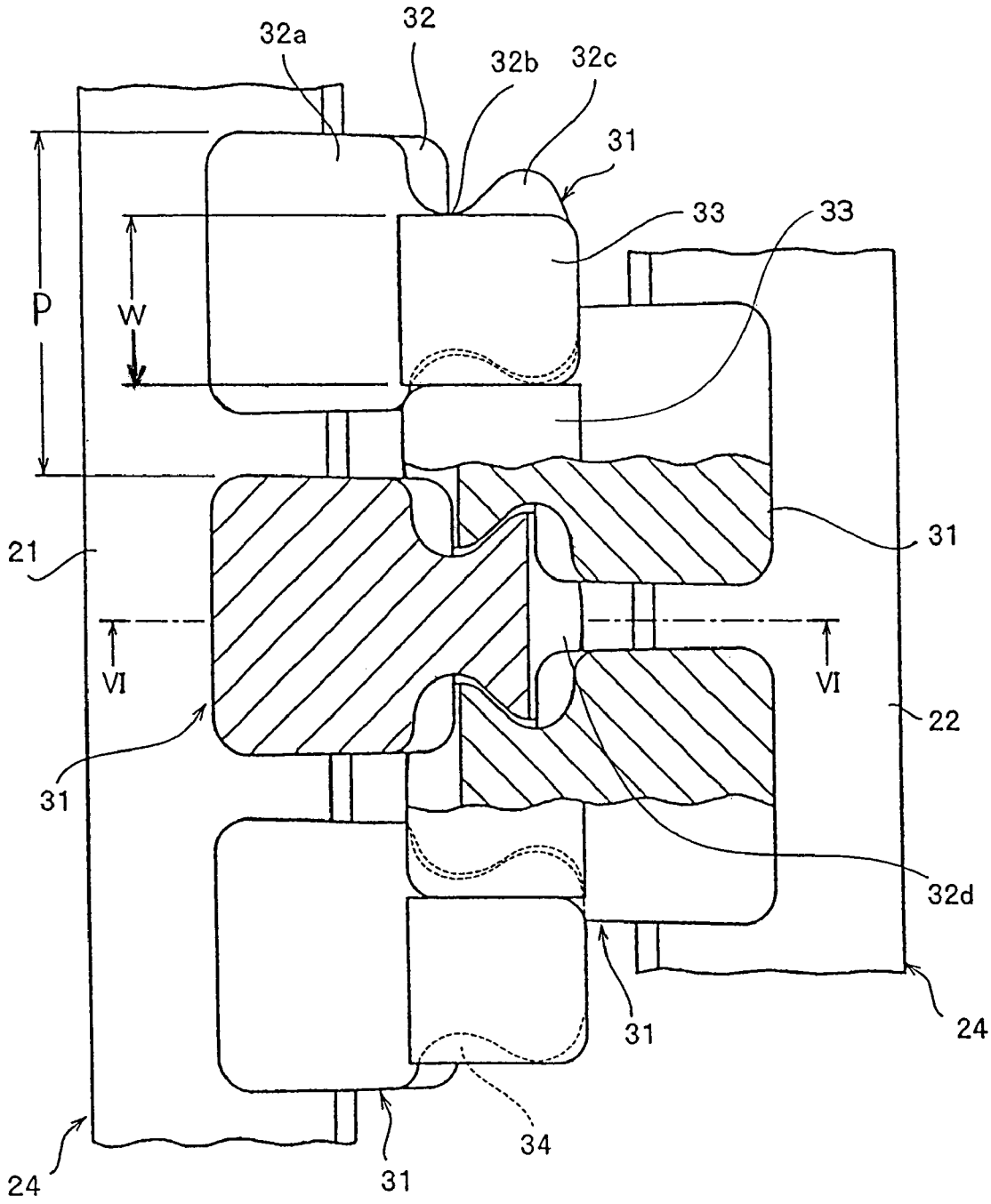
FIG. 5 is a partially dissected plan view of the engagement condition of the slide fastener.
Figure 6:
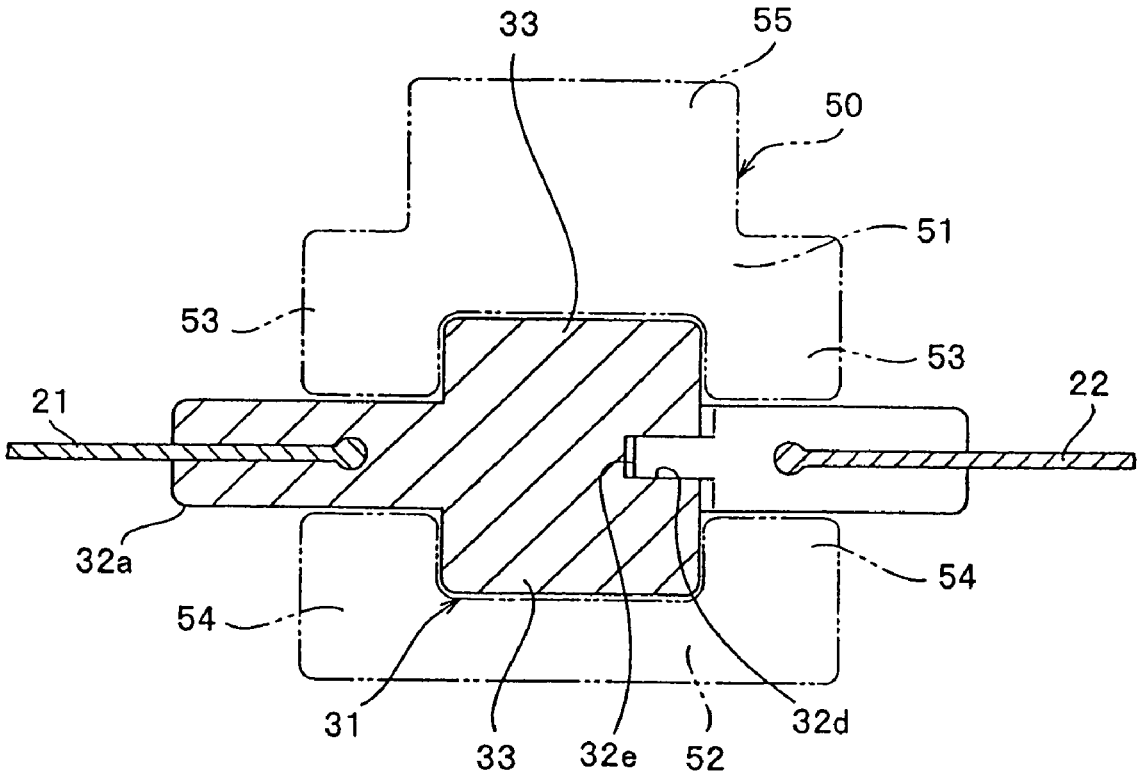
FIG. 6 is a sectional view taken along the line VI-VI of FIG. 5.
Figure 7:
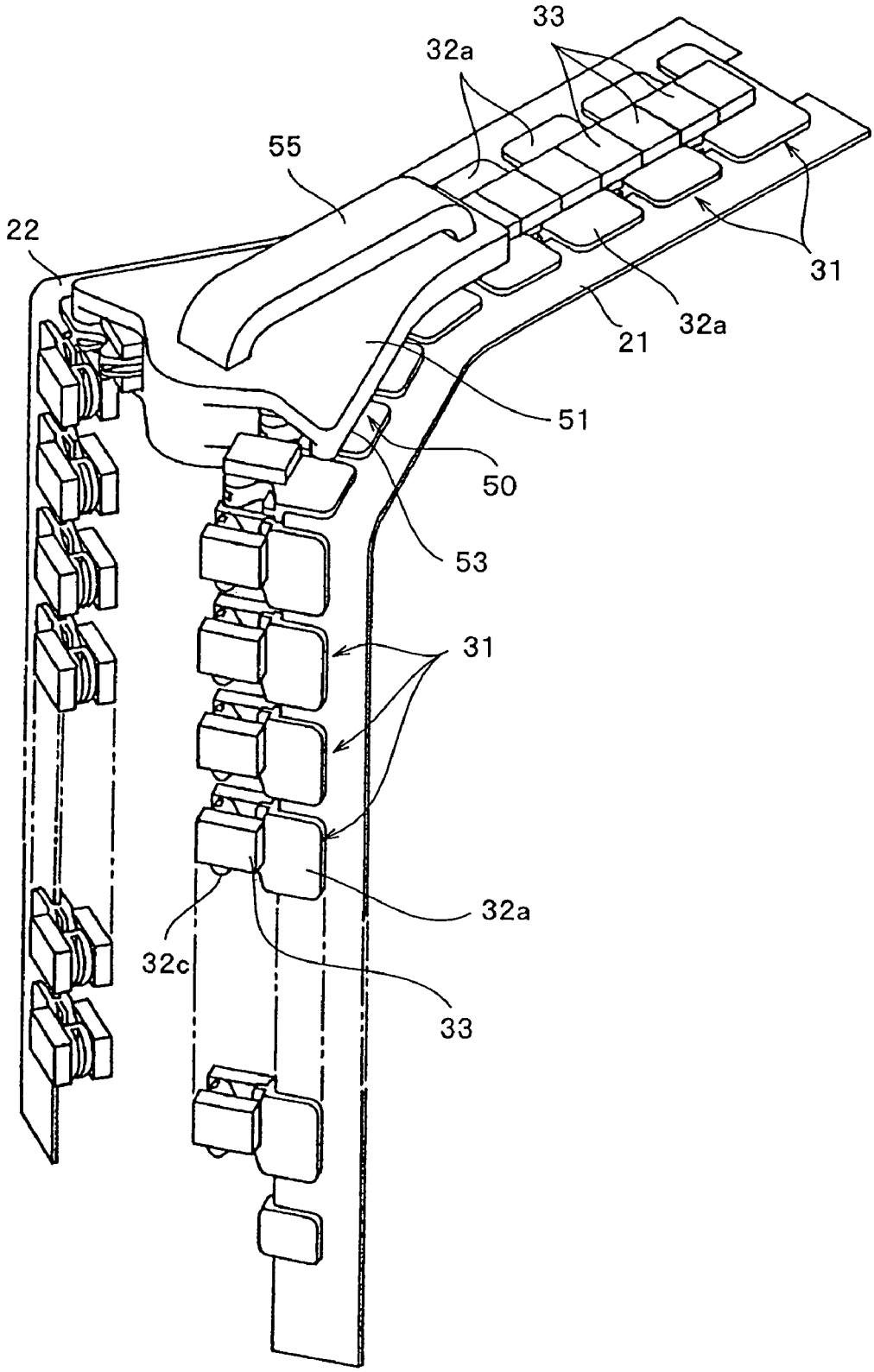
FIG. 7 is a perspective view showing engagement condition and separation condition of the elements of the slide fastener.

FIGS. 1 to 7 are the drawings regarding the first embodiment of the present invention. FIG. 1 is a plan view of an entire slide fastener. FIGS. 2 and 3 are perspective views of part of the fastener stringer as seen from their front obliquely on the right and left sides. FIG. 4 is a partial plan view showing element arrangement condition before the elements of right and left fastener stringers engage. FIG. 5 is a partially dissected plan view showing the element engagement condition after the elements are engaged. FIG. 6 is a sectional view taken along the line VI-VI of FIG. 5. FIG. 7 is a perspective view showing a difference in shape between the engaging portion and the separating portion of the fastener elements when the slide fastener is opened to halfway.

The slide fastener 10 of the present invention has right and left fastener stringers 24 in which a large number of fastener elements 31 are mounted along tape side edge portions of a pair of right and left fastener tapes 21, 22 like a conventional slide fastener as shown in FIG. 1. According to the indicated example, although a top end stop 41 is fixed adjacent to a fastener element 31 on the topmost end of one fastener tape 21, no top end stop is mounted on the other fastener tape 22. Further, a bottom end stop 42 for joining the side edge portions of the pair of right and left fastener tapes 21 is fixed between the tape side edge portions adjacent to fastener elements on the bottommost ends of the pair of right and left fastener tapes 21, 22. The fastener elements 31, the top end stop 41 and the bottom end stop 42 are made of thermoplastic synthetic resin material and integrated with the fastener tapes 21, 22, which are inserted into the mold (not shown) by injection molding. According to this embodiment, after the fastener elements 31, the top end stop 41 or the bottom end stop 42 is formed integrally on the fastener tapes 21, 22, a slider 50 is mounted and next, the bottom end stop 42 or the top end stop 41 is formed integrally on the aforementioned portion of the fastener tapes 21, 22. Finally, the slide fastener 10 is completed.

A portion of the most prominent feature of the present invention exists in the structure of the fastener element.

The aforementioned fastener element 31 of this embodiment, as shown in FIGS. 2 to 6, includes an element main body 32 having the same shape as an ordinary fastener element and including a base portion 32*a* to be mounted integrally on a fastener tape when the element is formed, a neck portion 32*b* continuous from the base portion 32*a* and projecting outward from the side edges of the fastener tapes 21, 22 and an engaging head portion 32*c* projecting outward from the same neck portion 32*b*, and rectangular (square in the same Figure) swollen portions 33 which extend from the outside ends of the base portion 32*a* up to the apex of the engaging head portion 32*c* via the neck portion 32*b* so as to be integrated with the front and rear faces (first surface and second surface) of the element main body 32.

This rectangular swollen portion 33 does not always need to be constituted of a single rectangular swollen portion but it may be constituted by forming tooth-like concavo-convex face on each of both end faces in the tape length direction of the rectangular swollen portion and combining plural rectangles which are fitted to the concavo-convex face of a mating plate-like piece when fastener elements are engaged. However, when the fastener elements are engaged, at least a partial flat face of the concavo-convex face needs to make contact with part of the mating concavo-convex face. In the indicated example, both end faces in the tape length direction of the rectangular swollen portion 33 act as a first contact plane when the fastener elements are engaged.

The base portion 32*a* of the element main body 32 is molded integrally with first surface and second surface of the fastener tapes 21, 22 while the base portion 32*a* sandwiches the first surface and the second surface, and it comprises a square shaped thin plate as seen in a plan view. The neck portion 32*b* projects outward of the tape from both ends in the tape length direction of the base portion 32*a* such that its dimension in the same direction decreases gradually drawing a curve and then, the engaging head portion 32*c* is curved from the neck portion 32*b* up to a dimensional position slightly shorter than the dimension in the tape length direction of the base portion 32*a*, so that the dimension in the tape length direction of the engaging head portion 32*c* expands so as to form expanding ends. Then, an apex portion is formed of curved faces, which protrude outward from those expanding ends and gradually narrow while being curved. When the fastener elements are engaged, the engaging head portion 32*c* of a mating element main body 32 engages with/disengages from between the neck portions 32*b*.

According to this embodiment, the rectangular swollen portions 33 formed integrally on the first surface and second surface of the element main body 32 have the same shape and same size. The position of one end face at an end in the tape length direction of each rectangular swollen portion 33 is disposed such that it deflects slightly outward from the expanding end position on one side of the engaging head portion 32*c* of the element main body 32 while the position of the other end in the tape length direction of the rectangular swollen portion 33 is disposed at a position in which the neck portion 32*b* of the element main body 32 narrows most. An end of each rectangular swollen portion 33 in the tape traversing direction is disposed at the position of an outward projecting end of the base portion 32*a* and the other end of the rectangular swollen portion in the tape traversing direction is disposed at the apex position of the engaging head portion 32*c*.

A concave portion 34 is formed between the respective rectangular swollen portions 33, in which the engaging head portion 32*c* of a mating fastener element 32 invades so as to fit. The concave portion 34 is surrounded by opposing inner faces of the rectangular swollen portions 33, an end face of an engaging head portion side of the base portion 32*a*, a side face of the neck portion 32*b* and an end face of the neck portion side of the engaging head portion 32*c*, and it is open to only a direction of the tape length direction.

As a result, most part of the neck portion 32*b* and one expanding end portion of the engaging head portion 32*c* are concealed by the rectangular swollen portion 33, so that part of the proximal end of the neck portion 32*b* and the other expanding end portion of the engaging head portion 32*c* are exposed outside. When the fastener elements 31 are engaged, part of the rectangular swollen portions, which are swollen from the first and second surface sides of the element main body 32 which engage each other, make contact with one expanding end portion of the engaging head portion 32*c* of the mating element main body 32 and part of the proximal end portion of the neck portion 32*b* in a sandwiching condition. At this time, the engaging head portion 32*c* is fitted to the concave portion 34 and opposing inside faces of the rectangular swollen portion 33 on the first surface side and the rectangular swollen portion 33 on the second surface side, which make firm contact with the neck portion 32*b* as an exposed plane and the front and rear faces of the engaging head portion 32*c*, serve as a second firm contact flat surface of the present invention.

According to the example in the drawing, a linearly extending fitting groove 32*d* is formed in the tape length direction in the apex curved face on an opposite to the neck side of the engaging head portion 32*c* of the element main body 32. A thin projecting piece 32*e* having a thickness substantially ⅓ the thickness of the element main body 32 is molded integrally and protrudedly from the end face on the side of the engaging head portion of the base portion 32*a* up to a most concave portion in the neck portion 32*b*. The groove width dimension of the fitting groove 32*d* is set equal to the thickness dimension of the thin projecting piece 32*e* or set slightly larger than the thickness dimension of the thin projecting piece. As a result, the thin projecting piece 32*e* is fitted to the fitting groove 32*d* when the fastener elements are engaged each other.

A large number of the fastener elements 31 having the above-described structure are molded integrally on opposing side edge portions of the right/left fastener tapes 21, 22 at a predetermined pitch P. The pitch P at this time is determined depending on the dimension in the tape length direction of the engaging head portions 32*c* which engage with the mating fastener element 31 as understood from FIG. 5. However, because according to the present invention, both side faces (first firm contact flat surface) in the tape length direction of the rectangular swollen portion 33 need to make firm contact with each other when the fastener elements 31 are engaged, the dimension between both the side faces of the rectangular swollen portions 33 needs to be at least ½ or more of the aforementioned pitch P.

According to this embodiment, ½ of the pitch P is set slightly smaller than the dimension in the tape length direction of the rectangular swollen portion 33 as shown in FIG. 4. The both side faces of the rectangular swollen portions 33 serves as a first firm contact face of the present invention. When the right/left fastener stringer 24 are engaged with each other as shown in FIG. 5, the degree of firm contact between the both side faces of the rectangular swollen portions 33 increases because the fastener tapes 21, 22 are pulled, by setting the ½ of the pitch P slightly smaller than the dimension in the tape length direction of the rectangular swollen portion 33.

On the other hand, because the rectangular swollen portions 33 swell from the first and second surfaces of the element main body 32 as described above, the base portion 32*a* of the element main body 32 enters into a gap between first and second side flanges 53, 54 projecting at a right angle from right and left end portions so that they are getting close to each other as seen from the sliding direction of the first and second blade plates 51, 52 of the slider 50, as shown in FIG. 6, so that sliding of the slider 50 is carried out not on the fastener tapes 21, 22, but on the surface of the base portion 32*a* of the element main body 32. Reference numeral 55 denotes a pull tag mounting column installed on the surface of the first blade plate 51 and the sliding operation of the slider 50 is carried out with a pull tag (not shown) installed on the same pull tag mounting column 55. By constructing the slider 50 in the above-described way, not only the sliding operation of the slider 50 is smoothed but also the width dimension of the slider 50 can be decreased without damaging the fastener tapes 21, 22 due to a sliding contact of the slider 50.

In the slide fastener 10 of this embodiment obtained in this way, as shown in FIGS. 5 and 7, the first firm contact planes (side faces) of the rectangular swollen portions 33 keep contact with each other in a fitting condition on the sides of the first and second front surfaces (front and rear faces of the tape) of a mating fastener element 31 at the engagement portion of the fastener element 31, and the second firm contact planes, which are opposing planes of the pairing rectangular swollen portions 33, keep firm contact such that they sandwich the first and second surfaces (planes) of an exposed portion of the neck portion 32*b*. As a consequence, respective fastener elements restrict the motion of each other so as to inhibit a rotation in a direction along the tape plane and a rotation in a direction perpendicular to the tape plane. As a result, the element engagement portion of the slide fastener 10 entirely stiffens linearly so as to turn to a rod-like shape.

According to this embodiment, when the fastener elements 31 are engaged, the thin projecting piece 32*e* projecting between the base portion 32*a* and the neck portion 32*b* is fitted to the fitting groove 32*d* formed in the engaging head portion 32*c* of the mating fastener element 31. At this time, if the thickness of the thin projecting piece 32*e* is matched with the groove width of the fitting groove 32*d*, opposing inside wall faces (second firm contact wall faces) of the fitting groove 32*d* and the flat surfaces on the sides of the first and second surfaces of the thin projecting piece 32*e* make firm contact with each other so as to enhance stiffening of the slide fastener when the fastener elements 31 engage.

On the other hand, at a portion where the fastener elements 31 of the right and left fastener stringers 24 are not in engagement, proper plasticity of the fastener tapes 21, 22 are secured because the fastener elements 31 are only attached to the fastener tapes 21, 22 with the predetermined pitch P, so that it can be bent freely. As a result, if the slide fastener of this embodiment is mounted on a supporting column portion of a tent, for example, when the slide fasteners 10 are closed, the slide fastener 10 automatically stiffens so as to maintain its configuration at the time when the tent is stretched. If the slide fasteners are opened in order to fold down the tent, the tent can be stored in a storage bag in a folding condition because the slide fastener is restored to its original plasticity.

Figure 8:
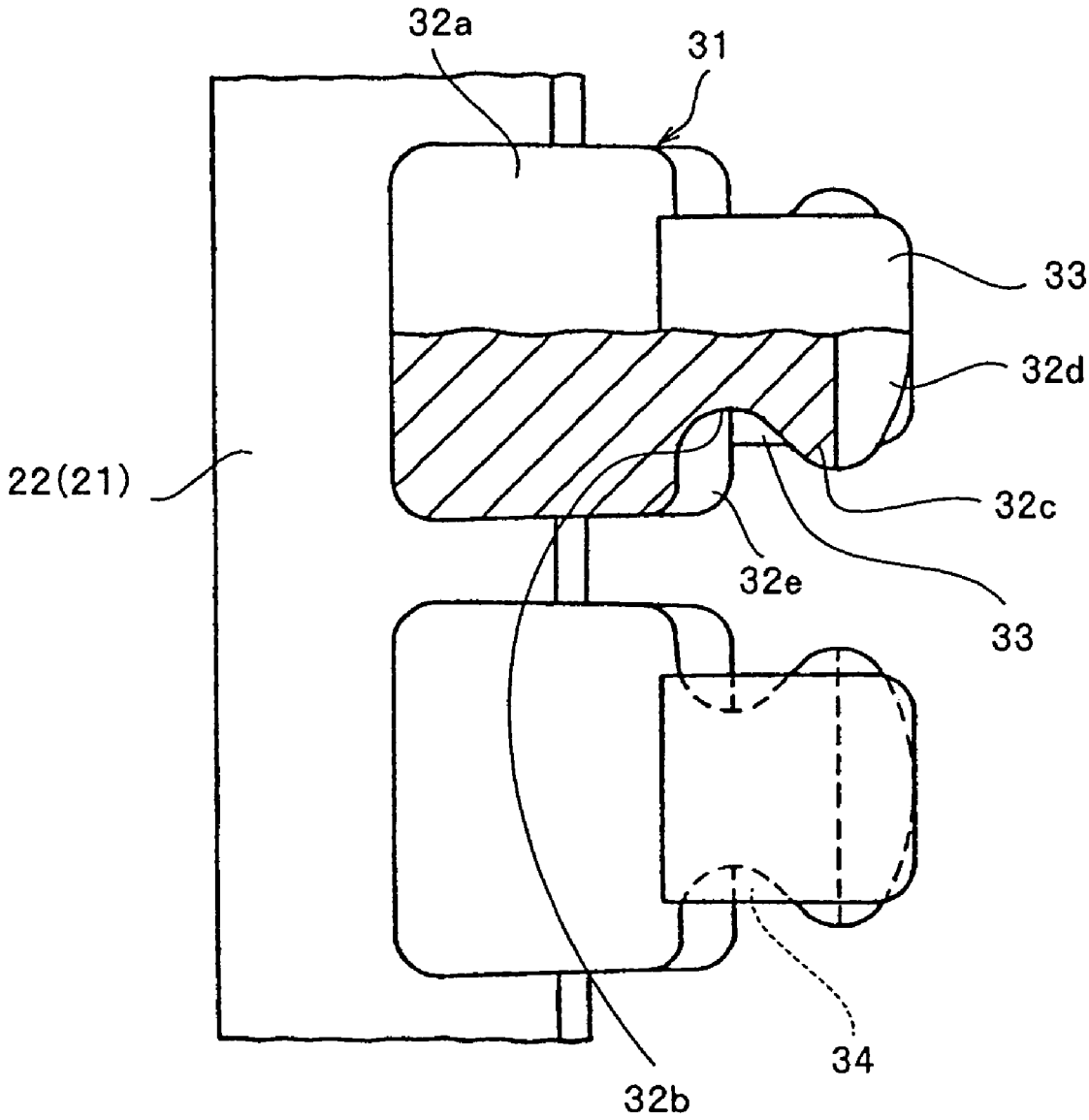
FIG. 8 is a partially dissected plan view of a first modification of the fastener element of the fastener stringer according to the first embodiment.
Figure 9:
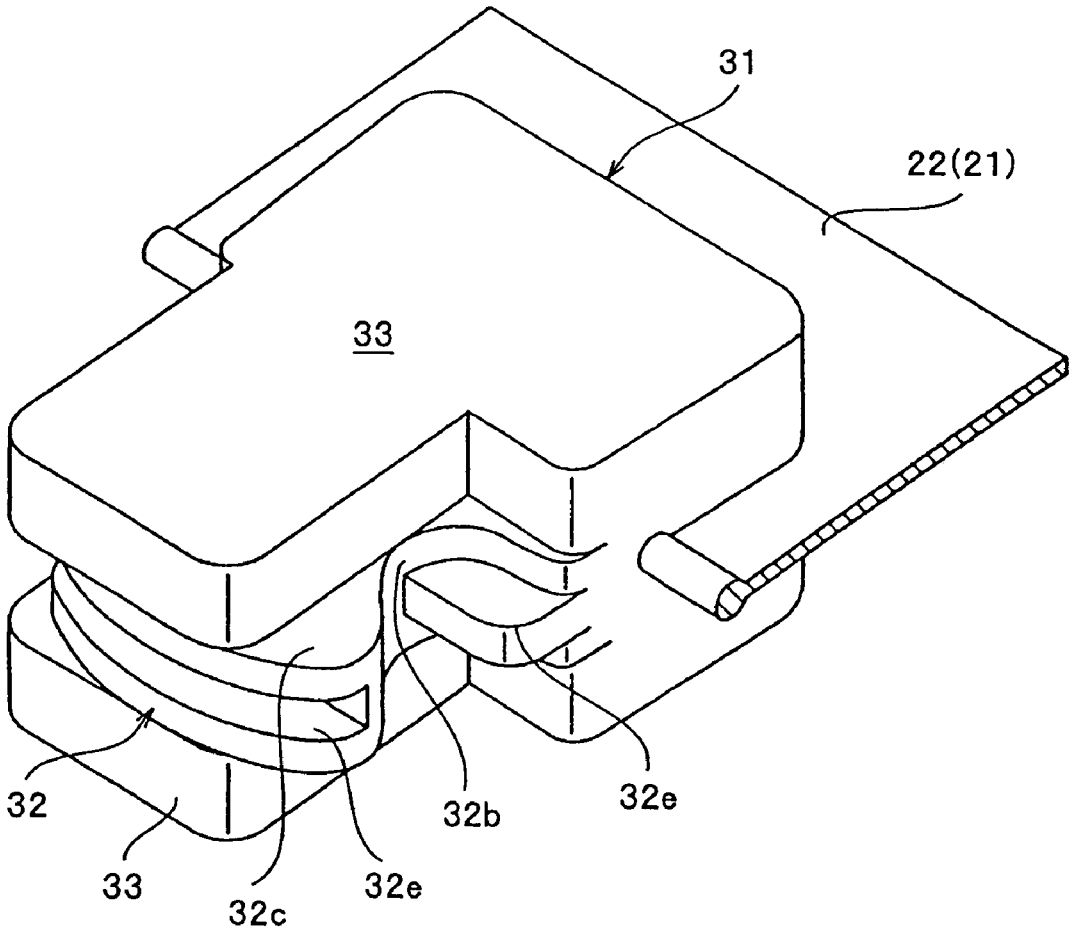
FIG. 9 is a perspective view of a second modification.

FIG. 8 shows a first modification of the first embodiment. This modification is different from the first embodiment in that the rectangular swollen portion 33 is disposed in the center portion of the width in the length direction of the fastener tapes 21, 22 of each fastener element 21, while other structure is substantially not different from the first embodiment. FIG. 9 shows a second modification of the first embodiment, which is different from the first modification. According to this modification, as shown in FIG. 9, the shape of the rectangular swollen portion 33 of the first embodiment is changed and its disposing portion is extended to the entire first and second surfaces of the base portion 32*a* of the element main body 32. As a result, the rectangular swollen portion 33 presents a substantially L-shape as seen in a plan view in which two rectangles are combined together. According to this second modification, in addition to the first firm contact plane area, a third firm contact plane which is a plane intersecting the first firm contact plane area and a side face extending in the length direction of the fastener tapes 21, 22 is formed and consequently, while the firm contact plane area increases, the stiffness both in the tape plane direction and in a direction perpendicular to the tape is secured when the fastener elements 31 are engaged and further, the stiffness is secured against a bending in the tape width direction also, so that the slide fastener stiffens in all directions.

Figure 10:
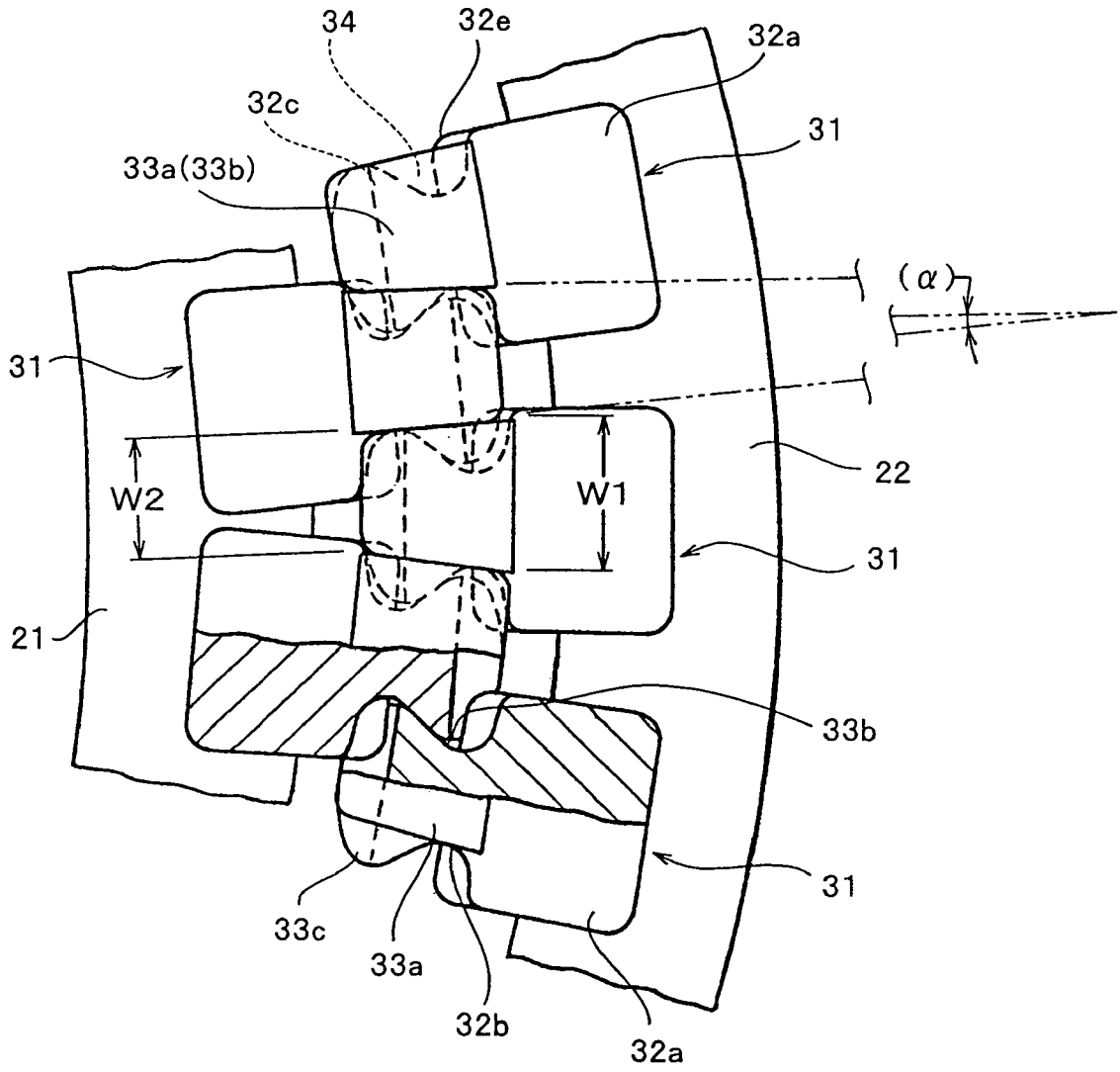
FIG. 10 is a partially dissected plan view showing part of the engagement condition of the slide fastener according to the second embodiment of the present invention.

FIG. 10 shows a second embodiment of the present invention. Although the indicated example shows an exaggerated shape to help understanding, the central angle (α) is smaller because actually, the actual dimension of the fastener element 31 is small. Although in this embodiment, the shape and structure of the element main body 32 of the fastener element 31 are substantially not different from the first embodiment, the shape of the rectangular swollen portion 33 is different from the first embodiment. In other words, according to this embodiment, the rectangular swollen portion 33 on the first surface side and the rectangular swollen portion 33 on the second surface side are of the same shape and same dimension and the length dimension in the tape length direction (width dimension) W1 on an end face on the a base portion side of each rectangular swollen portion 33 is set to be slightly longer than the length dimension in the tape length direction (width dimension) W2 of an end face of the engaging head portion side of the rectangular swollen portion 33 and further, a side face extending in the tape width direction is formed into a tapered face having the predetermined central angle (α) from the proximal portion side end to the engaging head portion side end.

When the slide fastener 10 of this embodiment is closed, the slide fastener 10 stiffens in a condition in which it draws a circle with the predetermined central angle (α) along a tape's plane as shown in FIG. 10, because the fastener elements 31 have the above-described structure. For example, if the slide fastener 10 of this embodiment is attached between a circular lid and a circular bottom of a cylindrical bucket or bag made of fiber sheet or synthetic resin sheet, the bucket or bag configuration is maintained stably because the slide fastener itself stiffens when the fastener elements 31 are engaged, and if the fastener elements 31 are separated by opening the slide fastener, the original plasticity of the fastener stringer is restored, so that the bucket or bag can be folded down easily and stored at an appropriate place.

Figure 11:
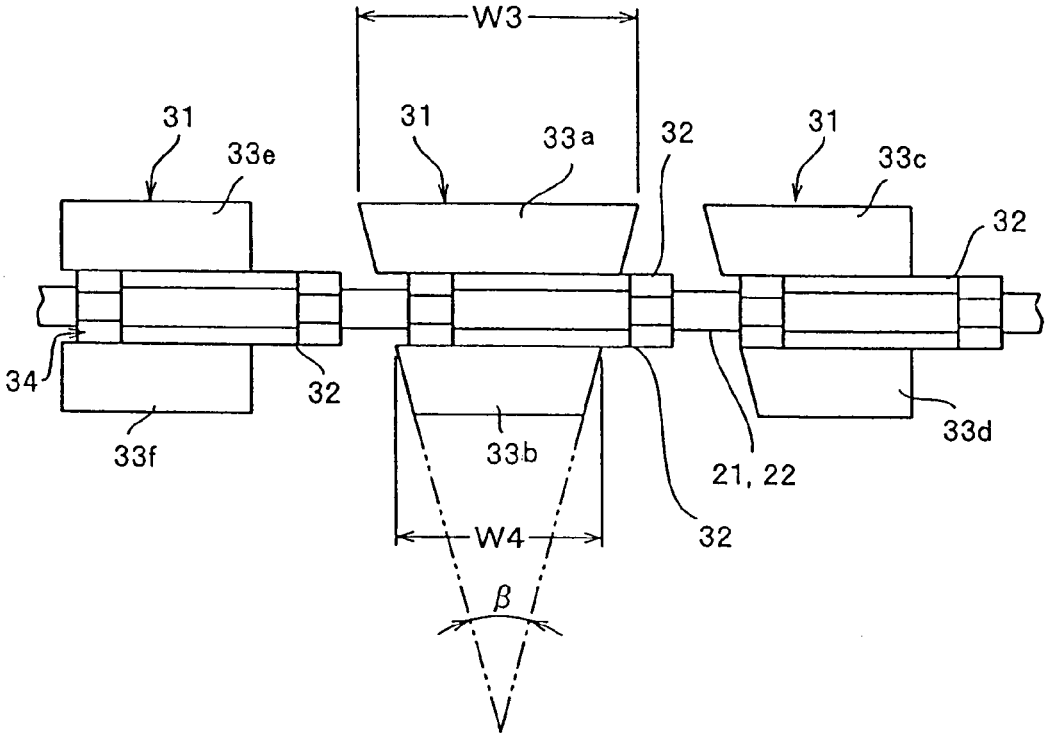
FIG. 11 is a partial side view of the slide fastener according to a third embodiment of the present invention.
Figure 12:
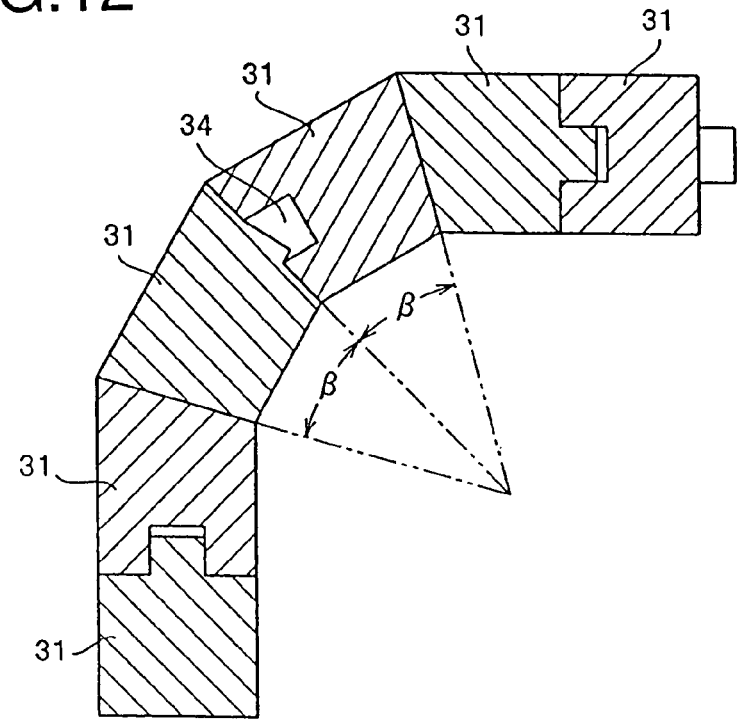
FIG. 12 is a sectional view showing the engagement condition of the fastener elements of the slide fastener.

FIGS. 11 and 12 show a third embodiment of the present invention. Although in this indicated example, a large central angle (β) is indicated like the above FIG. 10, the actual central angle (β) is smaller. Although according to this embodiment, the shape and structure of the element main body 32 of the fastener element 31 are substantially not different from the first embodiment like the second embodiment, the shape of the rectangular swollen portion 33 is different from the first embodiment and the second embodiment. That is, although according to this embodiment, the rectangular swollen portion 33 on the first surface side and the rectangular swollen portion 33 on the second surface side have almost the same shape, their dimensions are partly different. According to this embodiment, the section taken along the tape length direction of each of the rectangular swollen portions on the first surface side and the second surface side of the fastener elements 31 presents an inverse ladder shape. More specifically, the width dimension (W3) in the tape length direction of the rectangular swollen portion 33*a* on the first surface side is elongated by a predetermined ratio with respect to the width dimension (W4) in the tape length direction of the rectangular swollen portion 33*b* on the second surface side. At the same time, a straight line obtained by joining both ends of a bottom of the rectangular swollen portion 33*a* on the first surface side and a straight line obtained by joining both ends of a bottom of the rectangular swollen portion 33*b* on the second surface side exist on each same straight line and an intersection angle (central angle) of the respective lines is set to be a predetermined angle (β).

Although in one fastener stringer 24 shown in FIG. 11, of three adjoining fastener elements 31, a fastener element 31 disposed in the center has the above-described configuration, the side face of the central fastener element side of rectangular swollen portions 33*c*, 33*d* disposed on the first and second surface sides of a fastener element 31 adjoining this central fastner element on the right side in the same Figure is formed to be a taper-like tilt, the side faces on the right side of the same Figure are formed perpendicular to the tape plane. Further, although the side faces on the right and left in the Figure of rectangular swollen portions 33*e*, 33*f* disposed on the first and second surface sides of the fastener element 31 adjoining the central fastener element 31 on the left side in the same Figure are formed at right angle to the tape plane, the dimension in the tape length direction is set shorter than the same dimension of the first embodiment. In other fastener stringer 24 at this time, as shown in FIG. 12, the fastener elements 31 disposed on both the right and left sides of the central fastener element 31 such that it adjoins has a sectional shape inverse in the right and left direction to the aforementioned one fastener stringer 24.

Because the fastener elements 31 of this embodiment have the above-described structure, as shown in FIG. 12, it stiffens in a condition in which it draws a circle with a predetermined central angle (β) so that it is perpendicular to the tape plane when the slide fastener 10 of this embodiment is closed. For example, if the slide fastener of this embodiment is attached along the peripheral face of a suit case or a traveling bag, the fastener elements 31 stiffen with a shape following a curved face at a curved portion of the suit case or traveling bag and at the same time, they stiffen linearly at a straight line region on the periphery, maintaining the shape of the case or bag in a stable condition. Further, if the fastener elements 31 are separated by opening the slide fastener, the original plasticity of the fastener stringer is restored so that the fastener stringers can be folded easily with the main body of the case or bag and stored compactly at an appropriate storage place.

Figure 13:
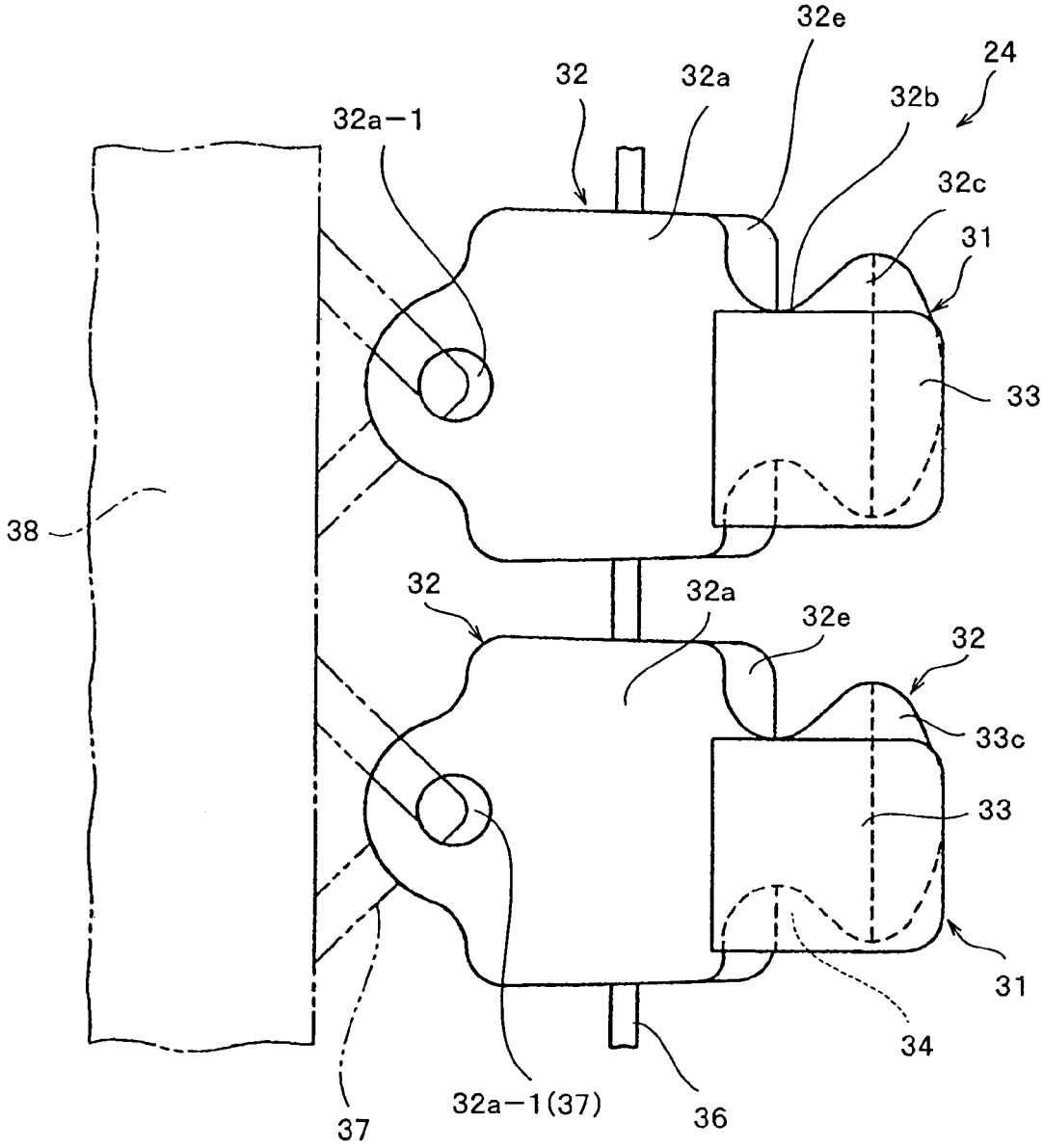
FIG. 13 is a partial plan view showing a condition in which the slide fastener according to a fourth embodiment of the present invention is mounted on a mounting object product.

FIG. 13 shows a fourth embodiment of the present invention. The slide fastener 10 of this embodiment is different from the first to third embodiments and with the fastener tapes 21, 22 excluded, the fastener elements 31 are formed integrally on a single string 36, 37 at a predetermined pitch (P) without being attached to the fastener tapes 21, 22. Although the entire shape and dimension of each fastener element 31 substantially coincide with the first embodiment, the base portion 32*a* is formed integral without being separated to the first surface side and the second surface side. A mounting object product attachment hole 32*a*-1 is formed at an end portion on the mounting object product side to attach a mounting object product 38 like a tent and the slide fastener 10 is attached to the mounting object product 38 by inserting an attaching member 39 like an attaching string into the mounting object product attachment hole 32*a*-1.

Although in this embodiment also, the slide fastener 10 stiffens turning to rod like when the fastener elements 31 are engaged, if the engagement of the fastener elements 31 is released, the slide fastener comes to have a plasticity of the strings 36, 37 joining the respective fastener elements 31, so that the fastener stringer 24 becomes foldable down easily.

Further, after the slide fastener 10 is closed as well, the plasticity of the mounting object product 38 is never blocked by the slide fastener 10 by joining the slide fastener 10 and the mounting object product 38 with the attaching member 39 having plasticity, because the slide fastener 10 and the mounting object product 38 are joined with the attaching member 39 like the attaching string.

As described above, the slide fastener turns to a rigid rod-like configuration when the fastener elements are engaged because the fastener elements have a new structure never seen before and when the fastener elements are separated, the fastener stringer regains the same plasticity as conventionally, and thus, the present invention is applicable to various fields not imaged conventionally.

In the meantime, the above-described embodiments are not restricted to the indicated examples but may be modified in various ways. Thus, various combinations are made possible as shown in FIGS. 11 and 12.

What is claimed is:

1. A slide fastener having a pair of right and left fastener stringers in which a large number of fastener elements are attached at a predetermined pitch in a length direction of fastener tapes, wherein each fastener element comprises:

an element main body having a base portion attached to each fastener tape, a neck portion projecting from the base portion, and an engaging head portion projecting from the neck portion and expanding in the length direction of the fastener tape so as to engage a mating engaging head portion; and stiffening means which is provided on the element main body, allowing the fastener stringers to bend when the fastener elements are separated and the stiffening means stiffening and blocking the fastener chain from bending when the fastener elements are engaged, the stiffening means comprises:

a first firm contact plane which makes firm contact with mating stiffening means when the fastener elements are engaged;

one or more rectangular swollen portions swollen respectively from the neck portion to the engaging head portion on first and second surfaces of the element main body;

the first firm contact plane is a side face extending in a fastener tape traversing direction and/or in a tape length direction of each rectangular swollen portion; and a concave portion, to which a part of the engaging head portion of the mating fastener element is fitted, is formed between the rectangular swollen portions swollen on the first and second surfaces.

2. The slide fastener according to claim 1, wherein the stiffening means comprises a second firm contact plane which makes firm contact with a partial surface of the engaging head portion of a mating fastener element when the fastener elements are engaged, and the second firm contact plane is an opposing face of each rectangular swollen portion which makes firm contact with a part of the first and second surfaces of the engaging head portion of the mating fastener element upon engagement.

3. The slide fastener according to claim 1, wherein the rectangular swollen portions are disposed at an equal interval (P) in the length direction of the fastener tapes and a pitch (P) between adjoining rectangular swollen portions is set to be smaller than twice a width dimension (W) in the length direction of the fastener tapes of the respective rectangular swollen portions.

4. The slide fastener according to claim 1, wherein the respective rectangular swollen portions of the first and second surfaces of the fastener element are a square or a rectangular having a same size.

5. The slide fastener according to claim 1, wherein the rectangular swollen portion of the first surface and the rectangular swollen portion of the second surface have a same shape and a width dimension (W1) of a first end portion in a tape length direction on an attachment side of the fastener element of the respective rectangular swollen portions is set to be longer than a width dimension (W2) of a second end portion in a tape length direction on a side of the engaging head portion of the fastener element.

6. The slide fastener according to claim 1, wherein right and left side faces extending along a tape traversing direction formed by joining the first end portion with the second end portion of the respective rectangular swollen portions of the first and second surfaces are formed to be an inclined face with a same inclination angle ($\alpha$).

7. The slide fastener according to any claim 1, wherein a width dimension (W3) in a tape length direction of the rectangular swollen portion on the first surface side is set to be longer than a width dimension (W4) in the tape length direction of the rectangular swollen portion on the second surface side by a predetermined ratio.

8. The slide fastener according to claim 1, wherein right and left side faces extending in the tape traversing direction of the respective rectangular swollen portions disposed on the first surface and the second surface are formed to be an inclined face having an inclination angle ($\beta$) in a tape penetrating direction.

9. A slide fastener having a large number of fastener elements molded integrally on one or more string bodies with a predetermined interval, wherein each fastener element comprises:

an element main body having a base portion to be attached to each string body, a neck portion projecting from the base portion, and an engaging head portion projecting from the neck portion and expanding in a length direction of the string body so as to engage a mating engaging head portion; and stiffening means which is provided on the element main body, allowing a fastener stringer to bend when the fastener elements are separated and the stiffening means stiffening and blocking the fastener chain from bending when the fastener elements are engaged, the stiffening means comprises:

a first firm contact plane which makes firm contact with mating stiffening means when the fastener elements are engaged;

one or more rectangular swollen portions swollen respectively from the neck portion to the engaging head portion on first and second surfaces of the element main body;

the first firm contact plane is a side face extending in a fastener tape traversing direction and/or in a tape length direction of each rectangular swollen portion; and a concave portion, to which a part of the engaging head portion of the mating fastener element is fitted, is formed between the rectangular swollen portions swollen on the first and second surfaces.

10. The slide fastener according to claim 9, wherein an attachment hole for attaching a mounting object body with an attaching string is formed in the base portion, and the slide fastener is attached on the mounting object body.

* * * * *